US011235377B2

(12) United States Patent
Hrabina

(10) Patent No.: US 11,235,377 B2
(45) Date of Patent: Feb. 1, 2022

(54) CASTING SYSTEM

(71) Applicant: FOSECO INTERNATIONAL LIMITED, Derbyshire (GB)

(72) Inventor: David Hrabina, Prevov-I mesto (CZ)

(73) Assignee: FOSECO INTERNATIONAL LIMITED, Barlborough Links (GB)

( * ) Notice: Subject to any disclaimer, the term of this patent is extended or adjusted under 35 U.S.C. 154(b) by 186 days.

(21) Appl. No.: 16/318,224

(22) PCT Filed: Jun. 14, 2018

(86) PCT No.: PCT/GB2018/051633
§ 371 (c)(1),
(2) Date: Jan. 16, 2019

(87) PCT Pub. No.: WO2019/002823
PCT Pub. Date: Jan. 3, 2019

(65) Prior Publication Data

US 2019/0168290 A1 Jun. 6, 2019

(30) Foreign Application Priority Data

Jun. 26, 2017 (EP) ..... 17275093

(51) Int. Cl.
*B22C 9/08* (2006.01)
*B22D 35/04* (2006.01)

(52) U.S. Cl.
CPC ..... *B22C 9/082* (2013.01); *B22D 35/04* (2013.01)

(58) Field of Classification Search
CPC ..... B22C 9/082; B22C 9/086; B22C 9/088
See application file for complete search history.

(56) References Cited

U.S. PATENT DOCUMENTS 1,657,952 A * 1/1928 Zoda ..... B22C 9/086 164/358
3,460,725 A * 8/1969 Horst ..... B22D 41/56 222/603

(Continued)

FOREIGN PATENT DOCUMENTS

CN 204584256 U 8/2015
RU 1811972 4/1993

(Continued)

OTHER PUBLICATIONS

International Preliminary Report on Patentability and Written Opinion dated Jan. 9, 2020 in corresponding International Application No. PCT/GB2018/051633, 7 pages.

(Continued)

*Primary Examiner* — Kevin E Yoon
*Assistant Examiner* — Jacky Yuen
(74) *Attorney, Agent, or Firm* — Nixon & Vanderhye PC

(57) ABSTRACT

Provided is a system for casting molten metals. The system includes a mould comprising a casting cavity having an inlet, and a bore between an upper surface of the mould and the inlet. The system further includes a shroud comprising a funnel and a hollow shaft, wherein the funnel is located outside of the mould, adjacent the upper surface, and the hollow shaft is received within the bore and is moveable therein. A lifting mechanism is located on the upper surface of the mould, the lifting mechanism being operable to lift the funnel of the shroud away from the upper surface for bringing the shroud into engagement with a ladle nozzle. Also provided is a method for casting molten metals using the system.

19 Claims, 9 Drawing Sheets

(56) References Cited

U.S. PATENT DOCUMENTS

| | | | | | |
|---|---|---|---|---|---|
| 4,205,721 | A * | 6/1980 | Jorn | B22D 35/04 | 164/335 |
| 4,550,867 | A * | 11/1985 | Bell | B22D 41/56 | 164/437 |
| 5,879,721 | A * | 3/1999 | Bradley | B22D 35/04 | 425/218 |
| 6,138,742 | A | 10/2000 | Billau | | |
| 2002/0124987 | A1 | 9/2002 | Soderstrom et al. | | |
| 2009/0218375 | A1* | 9/2009 | Ledbetter | B22D 37/005 | 222/590 |

FOREIGN PATENT DOCUMENTS

| | | |
|---|---|---|
| RU | 1449 U | 1/1996 |
| RU | 2 302 922 | 7/2007 |
| WO | 98/08636 | 3/1998 |
| WO | 2013/031967 | 3/2013 |

OTHER PUBLICATIONS

International Search Report for PCT/GB2018/051633 dated Jul. 27, 2018, 4 pages.
Written Opinion of the ISA for PCT/GB2018/051633 dated Jul. 27, 2018, 5 pages.
Office Action dated Mar. 9, 2021 in related Indian Application No. 201937000735 (with English-language translation), 7 pages.
Decision to Grant dated Sep. 20, 2021 in Russian Application No. 2019102919 (with translation), 10 pages.

* cited by examiner

CASTING SYSTEM

This application is the U.S. national phase of International Application No. PCT/GB2018/051633 filed Jun. 14, 2018 which designated the U.S. and claims priority to EP Patent Application No. 17275093.7 filed Jun. 26, 2017, the entire contents of each of which are hereby incorporated by reference.

The present invention relates to a system for casting molten metals. In particular, the invention relates to a casting system comprising a shroud for conveying molten metal between a ladle and a casting cavity within a mould.

One of the main challenges in metal casting processes is avoiding the entrainment of air and the surface oxide film. These can lead to defects, including air bubbles and oxide bifilms, which result in cracks in the casting.

Mid and heavy steel castings are conventionally cast from a bottom pour ladle, which releases molten metal through a nozzle located in its base. The nozzle is operated by a stopper rod or sliding gate installed at the bottom of the ladle. The ladle is elevated by a crane over a conical pouring basin which is connected to a downsprue that feeds into the mould. The ladle operator opens the nozzle by lifting the stopper or opening the sliding gate by an attached pneumatic mechanism to start the pouring process. The major drawback of this method of casting is that the pouring basin entrains masses of air into the metal. This entrained air travels with the molten metal through the running system and into the casting as bubbles, leading to oxide bifilms.

Further metal oxidation may occur when molten metal passes through a conventional gating system assembled from ceramic tiles. As the metal accelerates under gravity the metal stream narrows and this creates a vacuum effect, causing air to be sucked into the metal through unsealed junctions of the ceramic pipes which form the running system. Metal oxidation can also result from metal splashing and turbulence reacting with atmospheric oxygen inside the mould.

The contact of molten metal with air not only causes oxidation, but also results in nitrogen gas and hydrogen from atmospheric moisture being dissolved in the metal, which has a very negative effect on cast steel. It has been shown that the volume of air entrapped in the metal varies depending on the pouring process, and is a significant source of non-metallic inclusions which negatively influence the cleanliness, mechanical properties and surface quality of castings.

In addition to the problems resulting from air entrainment, a further drawback of the conventional casting process is that it is difficult to position the nozzle over the centre of pouring basin, since the ladle is suspended from a crane and its centre of gravity changes according to the metal volume in the ladle. Another problem is that metal splashing during conventional pouring poses a significant risk to ladle operators and staff nearby. The ladle held on the crane may move at any time. Splashing is particularly a risk during nozzle opening, since it is difficult to determine whether the nozzle is positioned precisely over the pouring basin.

One of the solutions to the problem of air entrainment in metal casting processes known in the art is contact pouring. This technique eliminates the use of a pouring basin, and instead the ladle nozzle is placed in direct contact with the entrance to the downsprue of the mould. The alignment between the ladle nozzle and the downsprue entrance is therefore critical. Again, a drawback of this technique is the requirement to move and precisely locate a ladle suspended from a crane.

The Harrison Steel Castings Company has offered an alternative solution to the problem of re-oxidation caused by air entrainment into the pouring stream. The Harrison process involves attaching a fused silica shroud below the nozzle of a bottom pour ladle. The mould is provided with a side riser for receiving the shroud. Below the side riser a pouring well is provided, which feeds into the casting cavity. With the shroud attached, the ladle is aligned over a mould and then lowered so as to insert the shroud into the side riser. The stopper rod is then moved to the open position so that molten metal within the ladle flows through the nozzle and the shroud into the mould. Once the mould is filled, the stopper is closed. The ladle is lifted until the shroud is clear of the mould, and is then moved over the next mould to repeat the process.

However, like the contact pouring method, a significant disadvantage of the Harrison process is the difficulty of manoeuvering the ladle on the crane, so as to insert the shroud into the side riser. It is also difficult and potentially hazardous for operators to mount the shroud on the nozzle, since they are required to work underneath a large elevated ladle.

The present invention has been devised with these issues in mind.

According to a first aspect of the invention, there is provided a system for casting molten metals, the system comprising:

a mould comprising a casting cavity having an inlet, and a bore between an upper surface of the mould and the inlet;

a shroud comprising a funnel and a hollow shaft, wherein the funnel is located outside of the mould, adjacent the upper surface, and the hollow shaft is received within the bore and is moveable therein; and a lifting mechanism located on the upper surface of the mould, the lifting mechanism being operable to lift the funnel of the shroud away from the upper surface for bringing the shroud into engagement with a ladle nozzle.

The use of a shroud reduces re-oxidation of the metal on pouring between the ladle and the mould, thereby reducing the introduction of inclusions into the casting. The shroud also controls and reduces turbulence in the metal flow, which reduces the potential for air entrapment and abrasion of the mould, which in turn reduces the level of inclusions. Reducing the level of inclusions and lap defects leads to an overall improved casting surface finish. However, while shrouding is, in general, well known, the benefits of the present invention are achieved by locating the shroud in the mould itself (i.e. within a bore which extends between a surface of the mould and the casting cavity), and by the provision of a lifting mechanism on the mould which lifts the shroud upwards to engage with the ladle.

This has numerous advantages over prior art systems in which a shroud is fixed to the ladle nozzle and the whole ladle is lowered in order to bring the shroud into proximity with a mould. Firstly, the invention avoids the need for operators to work underneath a large elevated ladle in order to attach a shroud to the ladle, which is extremely hazardous. Secondly, the efficiency of the casting process is significantly improved since no time is wasted mounting the shroud on the ladle prior to casting, or lowering the shroud into each mould cavity and lifting it up again after pouring. The lifting mechanism of the invention enables quick and safe engagement and disengagement of the shroud with the ladle nozzle. This also allows the ladle to be emptied of slag immediately after pouring, resulting in a cleaner ladle. Thirdly, since each mould cavity contains its own shroud, which is lifted upwardly to engage with the ladle nozzle, the invention avoids the need to manoeuver the ladle with a pre-attached shroud precisely into each mould. This makes manoeuvrability of the ladle easier between pours, and also reduces the risk of damaging the mould caused by insertion and removal of a shroud which is permanently fixed to the ladle.

The lifting mechanism is mounted on the upper surface of the mould, and functions to lift the funnel of the shroud into engagement with the nozzle of the ladle. Since the shaft of the shroud is moveable within the bore of the mould, the whole shroud can be lifted upwardly through operation of the lifting mechanism.

In some embodiments the system further comprises a rotating mechanism for rotating the shroud relative to the mould. The rotating mechanism may be combined with the lifting mechanism. For example, lifting of the shroud by the lifting mechanism may also effect rotation of the shroud, or rotation of the shroud may effect lifting. Thus, in some embodiments the lifting mechanism is further operable to rotate the shroud relative to the mould. In some embodiments the lifting mechanism is operable to rotate the shroud independently of lifting of the shroud.

In some embodiments the lifting mechanism comprises a first part which is mounted (directly or indirectly) on the surface of the mould, and a second part which supports the funnel of the shroud, wherein the second part is moveable relative to the first part.

In some embodiments the position of the first part is fixed relative to the mould and movement of the second part effects lifting of the funnel away from the mould and into engagement with the ladle nozzle. In some embodiments the second part is moveable between a first position, in which the shaft is substantially received within the bore of the mould, and a second position, in which a portion of the shaft is lifted out of the bore.

In some embodiments, the first part is moveable relative to the mould, the first part being moveable between a first position, in which the shaft is substantially received within the bore of the mould, and a second position, in which a portion of the shaft is lifted out of the bore. In some embodiments, the first part is moveable between the first and second positions without movement of the second part. The movement of the first part between the first and second positions may effect lifting of the shaft without rotating the second part and/or the shaft.

In some embodiments the lifting mechanism further comprises a third part which is disposed between the first part and the surface of the mould. The third part may facilitate movement of the first part relative to the mould.

In some embodiments the first part or the third part (if present) of the lifting mechanism comprises or consists of a base which is fixed to the upper surface of the mould, thereby securing the lifting mechanism to the mould.

It will be appreciated that there are numerous ways in which the lifting mechanism can be implemented to provide movement of the second part relative to the first part or movement of the first part relative to the mould and, optionally, the second and/or third parts. For example, the lifting mechanism may comprise a mechanical actuator, such as a screw or cam-based mechanism, a jack (e.g. a pantograph jack), or a telescoping linear actuator. Alternatively, the lifting mechanism may comprise a hydraulic or pneumatic actuator or piston. In some embodiments, the lifting mechanism comprises a motor.

In some embodiments, a seal is provided between the base and the upper surface of the mould.

In some embodiments, a seal is provided between the second part of the lifting mechanism and the funnel of the shroud.

In some embodiments, there is substantially no gap between the first part and the second and/or third parts of the lifting mechanism.

By sealing between the ladle nozzle and the shroud funnel, between the lifting mechanism and the mould, between the lifting mechanism and the funnel of the shroud, and also by having substantially no gap or only a very narrow gap between the first part and the second and/or third parts of the lifting mechanism, it is possible to provide a substantially closed system through which metal can flow from the ladle, through the shroud and into the casting cavity within the mould. This reduces re-oxidation and lowers the formation of inclusions within the casting. However, it will be appreciated that it is not possible for the system to be completely air-tight.

In some embodiments, the lifting mechanism comprises a cylindrical cam. As is known in the art, a cylindrical cam is a cam in which a follower rides on a surface of a cylinder. The surface is angled, forming a spiral or helix. The surface may be formed as a groove formed within a curved wall or surface of the cylinder, or it may form an end of the cylinder. The follower undergoes translational movement parallel to the longitudinal axis of the cylinder as it rides along the surface, thus converting rotational motion to linear motion.

In some embodiments, the lifting mechanism comprises concentric outer and inner collars, wherein one of the inner and outer collars supports the funnel of the shroud and has a follower which rests on a ramped or spiral surface (i.e. a cam) of the other of the inner and outer collars which is mounted (directly or indirectly) on the upper surface of the mould, such that relative rotation of the inner and outer collars causes linear motion of the shroud.

In some embodiments, the ramped surface is formed in an upper end of the inner or outer collar.

In some embodiments, the shroud is seated in the inner collar, the inner collar having a follower which rests on a ramped surface of the outer collar, which is mounted (directly or indirectly) on the upper surface of the mould. In such embodiments, the outer collar may be considered to correspond to the first part, and the inner collar may be considered to correspond to the second part of the lifting mechanism.

In some embodiments the position of the outer collar is fixed relative to the mould, and rotation of the inner collar relative to the outer collar causes linear motion of the shroud. It will be appreciated that in such embodiments, the shroud itself also rotates as it is lifted.

In some alternative embodiments, the outer collar is moveable relative to the mould and the inner collar. This may be facilitated by the provision of the third part between the first part and the surface of the mould. In such embodiments rotation of the outer collar effects linear motion of the shroud without rotation of the inner collar and the shroud supported therein. Rotation of both the inner and outer collars together (such that there is no relative movement between them) will then cause rotation of the shroud without linear motion. This arrangement can be used to provide greater control over the metal flow. For example, lifting of the shroud by rotation of the outer collar may enable metal flow through the shroud, while subsequent rotation of the shroud may be used to open additional outlets and increase the metal flow.

In some embodiments, multiple ramped surfaces are provided. Each ramped surface may extend over a portion of the collar in a circumferential direction. In some embodiments, two, three or four ramped surfaces are provided. For example, three ramped surfaces may be provided, each extending over an angle of approximately 120° in a circumferential direction.

In some embodiments the lifting mechanism further comprises a handle for effecting relative rotation of the inner and/or outer collar. In some embodiments, the handle is attached to or constitutes the follower.

The lifting mechanism may be made from any suitable material. In some embodiments, at least a part of the lifting mechanism is made from metal, such as steel.

The funnel of the shroud may have an interior surface that is part-spherical in shape (concave). This enables a ball and socket-like engagement with the ladle nozzle. This provides a secure connection with the ladle nozzle, even if the ladle nozzle and the shroud, and/or the shroud and the mould are not perfectly aligned.

In some embodiments, the system further comprises a gasket located in the funnel of the shroud. The gasket helps to ensure that the connection between the shroud and the nozzle is sealed.

The shroud may be manufactured from any refractory material capable of withstanding the high temperatures of molten metal, such as molten iron and steel. Suitable refractory materials include fused silica, precast concrete, and iso-statically pressed carbon bonded refractories. In some embodiments the shroud is made from fused silica.

In addition to having suitable thermal and physical properties, the shroud must be made to high dimensional accuracy, which means that certain manufacturing methods (e.g. slip casting, in which the material forming the shroud is partially hardened and cured in the mould prior to stripping and firing) are more suitable than others.

The bore in the mould, in which the hollow shaft of the shroud is moveably received, extends between the upper surface of the mould and the inlet of the casting cavity. By "extends between", it will be appreciated that the bore may extend the entire distance between the upper surface of the mould and the inlet of the casting cavity, or the bore may extend for only a part of the distance.

The shaft of the shroud is received within the bore with only a small gap therebetween. In some embodiments, the shaft of the shroud extends the full length of the bore. The close fit of the shroud and having the shaft extending substantially the full length of the bore allows for effective control of the metal flow, eliminating splashing and reducing re-oxidation. Any air present in the gap between the shroud and the bore is not in direct contact with the stream of metal, and therefore there is no air entrapment. This narrow air gap also allows for ventilation of the running system when metal enters the mould.

In some embodiments, the casting system further comprises a filter. The filter may be located between the bore and the inlet of the casting cavity. The filter functions to remove any inclusions from the molten metal. The filter also acts as a flow modifier and reduces turbulence in the molten metal before it flows into the casting cavity. The filter may be made from any suitable material as would be known to those skilled in the art. In some embodiments the filter is made from zirconia.

In some embodiments, the filter is located within a housing. The housing may be connected to the bore (directly or indirectly). In some embodiments, the housing receives an end of the shaft of the shroud (i.e. the end opposite the funnel). In these embodiments, molten metal flows through the shroud, which is received within the bore), into the housing and through the filter before passing into the casting cavity.

The housing may be square, rectangular, triangular, hexagonal, octagonal or circular in cross section. Thus, in some embodiments the housing has three, four, six, or eight side walls. One or more of the side walls may have an outlet therein through which molten metal flows to the casting cavity. A filter may be located adjacent each outlet. The housing and filter configuration can therefore be selected according to the specific requirements of the casting cavity.

The housing may be manufactured from any suitable refractory material, including fused silica, precast concrete, fireclay and chemically bonded sand. In some embodiments the housing is made from fused silica.

In some embodiments the housing contains a refractory impact pad. This prevents erosion of the mould by the molten metal as it flows out of the end of the shroud.

The end of the shroud (opposite the funnel) may be completely open. Alternatively, the end may be provided with a base or end cap having an opening therein for molten metal to flow through. In use, the base or end cap may be seated on the impact pad prior to lifting of the shroud.

The impact pad may be manufactured from any suitable refractory material capable of withstanding the thermal and physical impact of molten metal, including fused silica, precast concrete, fireclay and chemically bonded sand. In some embodiments the impact pad is made from fused silica.

In some embodiments, at least one outlet is provided in the shaft adjacent to the end of the shroud. At least two, three or four outlets may be provided. The outlets may be regularly spaced around the shaft of the shroud. These 'horizontal' outlets provide a further flow path for molten metal to exit the shroud, in addition to the opening at the end of the shroud, and thus enable a greater flow rate when all outlets are open.

A flow control means may be provided for controlling the flow of metal through the outlet(s) in the shaft. The shroud may be rotatable between a position in which each outlet is aligned with and closed by the flow control means, thereby preventing metal flow through the outlets, and a position in which each outlet is open (and no longer aligned with the flow control means), thereby allowing metal to flow through the outlet(s). It will be appreciated that there may be a series (e.g. a continuum) of positions between the open and closed positions in which the outlet(s) are partially open. In such embodiments, rotation of the shroud can advantageously be used to control the flow rate of metal into the casting.

In some embodiments the flow control means is provided by the impact pad.

In some embodiments the impact pad may comprise at least one pillar or wall having a surface which abuts the shaft of the shroud, the height and width of said surface being sufficient to completely cover an outlet. It will be appreciated that the height of the pillar(s) or wall(s) must be selected such that the surface completely covers the outlet(s) when the shaft is lifted by the lifting mechanism.

In some embodiments the shroud is rotatable between a position in which the (or each) pillar is aligned with the outlet (or its respective outlet) so as to close the outlet and prevent metal flow therethrough, and a position in which the (or each) outlet is at least partially open. Preferably the number of pillars corresponds to the number of outlets. In some embodiments, the shaft comprises four outlets and the impact pad comprises four pillars.

In some embodiments, the impact pad comprises a wall which extends around the shaft of the shroud (i.e. forming a ring). The wall comprises one or more holes which are positioned such that they are at least partially alignable with the outlet(s) in the shaft of the shroud. In such embodiments the shroud is rotatable between a position in which the outlet(s) is (are) covered by the wall so as to close the outlet and prevent metal flow therethrough, and a position in which the (or each) outlet is at least partially aligned with the hole (or its respective hole) in the wall and thus at least partially open, thereby allowing metal to flow out of the shroud through the outlets and the holes.

In some embodiments, a surface of the impact pad comprises a region which is complementary in shape to the base of the shroud. The region may be shaped such that mating between the base of the shroud and the surface is only possible in certain orientations of the shroud relative to the impact pad. For example, mating between the base and the surface may only be possible when the outlet(s) of the shaft are aligned with the flow control means. Thus, the complementarity between the base and impact pad provides a useful means of determining when the outlets in the shaft are closed.

The pillars or wall(s) may extend upwardly from the surface of the impact pad.

In some embodiments, the system further comprises a running system between the housing and the inlet of the casting cavity.

In some embodiments, the system further comprises a riser in fluid communication with the casting cavity. The riser may be a natural sand riser comprising a cavity formed in the mould or it may be an aided riser, commonly referred to as a feeder or feeder sleeve. Feeder sleeves are typically chemically bonded refractory shapes and may be insulating and/or exothermic. The riser may extend between the casting cavity and the upper surface of the mould. The riser or feeder sleeve may be open and exposed to the atmosphere or it may closed, having a roof or lid. In some embodiments the mould comprises more than one riser.

In some embodiments the system comprises a side riser. The side riser may be situated adjacent the casting cavity. The side riser may be situated in the lower part of the mould, i.e. distal to the upper surface of the mould. An end of the shaft of the shroud may be located in the side riser, in fluid communication with the casting cavity.

In some embodiments, the casting cavity is bottom-fed. By "bottom-fed", it will be understood that the casting cavity is filled upwards by molten metal entering from the running system into the bottom of the casting cavity.

In some embodiments, the running system comprises one or more conduits or runners in the mould, each conduit extending between an outlet of the housing or side riser and an inlet of the casting cavity.

The casting system of the invention may be applicable to any bottom pour ladle fitted with a nozzle. In some embodiments, the nozzle of the ladle is part-spherical (convex), or flat top domed, in shape.

Furthermore, a single universal nozzle diameter may be used for any and all castings.

The rate or volume of metal that can be poured from a bottom pour ladle is restricted by the diameter of the nozzle being used. When a shroud is fitted, the flow of metal may then be restricted further depending on the internal diameter or bore of the shaft of the shroud.

In conventional applications where the shroud is fixed to the ladle and then used to cast more than one mould, the metal flow rate will be the same for each casting. If castings of significantly different sizes are to be cast from the same ladle, it is possible that the flow rate may be unsuitable for certain large or small casting sizes, resulting in non-optimised mould filling and increased casting defects or rejects. This means that for each ladle of metal, similar sized castings have to be made using the same required nozzle size and single shroud diameter.

With the casting system of the present invention, a new shroud is used for each casting which advantageously allows for a variety of different sizes and dimensions of castings to be produced from a single run (ladle). This is because each mould contains its own shroud, the size and bore diameter of which can be selected according to the casting size. The type of shroud used is therefore optimised for the individual casting, rather than being dictated by the ladle or nozzle type (diameter). For example, a shroud having a 80 mm bore diameter and one having a 40 mm bore diameter may both have the same funnel dimensions allowing them to fit to a single nozzle, hence can be used to cast from the same ladle fitted with a universal nozzle.

The system of the invention is therefore much more flexible and applicable to short casting runs than typical systems currently being used. A further advantage is that a clean shroud is used for each casting, thus further reducing the presence of inclusions.

Thus, in some embodiments, the system comprises a plurality of moulds. The shroud in each mould may be the same length and/or diameter. Alternatively, different moulds may contain shrouds of different lengths and/or diameters.

It will therefore be appreciated that the length and diameter of the shroud will be selected according to the type of casting. For example, small castings may be cast using a shroud having an internal bore diameter of 30 mm, while a heavy casting may require a shroud having a bore diameter of 70 mm. Different shrouds of different bore diameters can be used with a universal nozzle.

In some embodiments, the bore diameter of the shroud is from 20 mm to 100 mm, from 30 mm to 80 mm or from 40 to 70 mm.

By including the shroud within the mould itself, and selecting the shroud in accordance with the individual casting, there is no limitation on the length of the shroud used. In some embodiments, the length of the shroud is from 1 to 3 metres, or from 1.5 to 2 metres.

The mould may be a conventional sand mould as is commonly used in metal casting. The casting system of the invention can therefore be prepared by using any suitable foundry moulding sand system.

Moulding sand can be classified into two main categories; chemical bonded (based on either organic or inorganic binders) or clay-bonded. Chemically bonded moulding sand binders are typically self-hardening systems where a binder and a chemical hardener are mixed with the sand and the binder and hardener start to react immediately, but sufficiently slowly enough to allow the sand to be shaped around the pattern plate and then allowed to harden enough for removal and casting. Clay-bonded moulding systems use clay and water as the binder and can be used in the "green" or undried state and are commonly referred to as greensand. Greensand mixtures do not flow readily or move easily under compression forces alone and therefore to compact the greensand around the pattern and give the mould sufficient strength properties, a variety of combinations of jolting, vibrating, squeezing and ramming are applied to produce uniform strength moulds at high productivity.

Chemically bonded moulding sands are most suited to the manufacture of low volume and/or mid and large sized iron and steel castings, and typically have higher strengths compared to greensand systems.

Moulding practices are well known and are described for examples in chapters 12 and 13 of Foseco Ferrous Foundryman's Handbook (ISBN 075064284 X). A typical process known as the no-bake or cold-setting process is to mix the sand with a liquid resin or silicate binder together with an appropriate catalyst, usually in a continuous mixer. The mixed sand is then compacted around the pattern by a combination of vibration and ramming and then allowed to stand, during which time the catalyst begins to react with the binder resulting in hardening of the sand mixture. When the mould has reached a handleable strength, it is removed from the pattern and continues to harden until the chemical reaction is complete. If feeder sleeves are employed, they may be placed on the pattern plate and the mixed sand applied around them, or they may be inserted into cavities in the mould after removal from the pattern. Similarly, filter housings and filters may be moulded in place or inserted afterwards.

Moulds are typically made in two halves and then assembled prior to casting, although for larger and more complex castings, moulds may comprise three or more parts assembled together. Moulds are typically horizontally parted, but may be vertically parted for some casting configurations.

A sand mould may be made within a metal frame. This provides support to the mould. The frame may be provided with handles. The handles can be used for lifting the two mould halves, and assembling and manipulating the complete mould.

Whilst the casting system of the present invention is particularly suited for the manufacture of steel castings, it may also be used for casting other metals such as grey iron, bronze, copper, zinc, magnesium, aluminium and aluminium alloys.

In some embodiments, the mould may be a permanent mould or die. A permanent mould or die may be made from cast iron, steel or any other suitable materials which will be known to the person skilled in the art. These embodiments are suitable for the manufacture of aluminium and aluminium alloy castings.

According to a further aspect of the present invention there is provided a method of casting using the system of the first aspect.

The method may comprise the steps of:

providing the system of the first aspect of the invention;

positioning a bottom pour ladle containing molten metal over the mould such that a nozzle in a base of the ladle is located substantially vertically above the funnel of the shroud;

operating the lifting mechanism so as to lift the funnel of the shroud away from the upper surface of the mould to bring the shroud into engagement with the nozzle;

opening the nozzle, thereby allowing molten metal to flow from the ladle into the shroud;

closing the nozzle to stop the flow of molten metal; and operating the lifting mechanism so as to lower the funnel of the shroud towards the upper surface of the mould to disengage the shroud from the nozzle.

In some embodiments, operating the lifting mechanism so as to lift the funnel of the shroud also effects rotation of the shroud relative to the mould.

In alternative embodiments, operating the lifting mechanism lifts the funnel of the shroud without rotating the shroud relative to the mould. In such embodiments, the method may further comprise the step of, after opening the nozzle, rotating the shroud.

In some embodiments, the method further comprises purging the mould with an inert gas, such as argon. To retain the inert gas the mould must be closed to prevent ventilation prior to pouring. For example, in some embodiments, it may be necessary to close any open risers or vents simply by placing a sheet or paper or card over the vent. Argon is heavier than air, so once a mould has been closed the argon does not tend to leak out before pouring.

It will be appreciated that any of the embodiments described herein may be combined with any other embodiment as appropriate, unless otherwise stated.

Embodiments of the invention will now be described with reference to the accompanying drawings in which.

Figure 1:
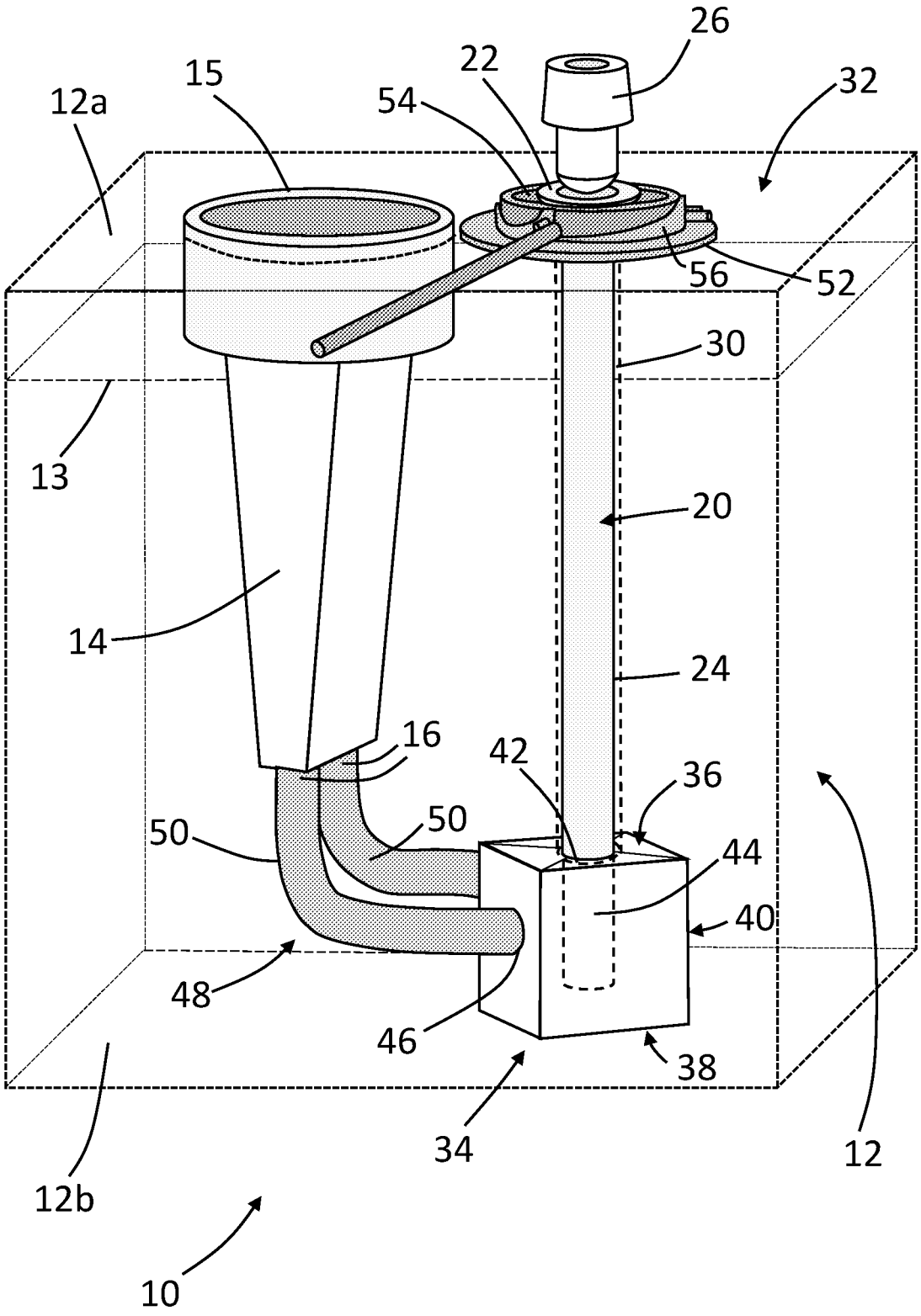
FIG. 1 is a perspective view of a casting system in accordance with the first aspect of the invention, wherein the funnel of the shroud is not engaged with the ladle nozzle.
Figure 3B:
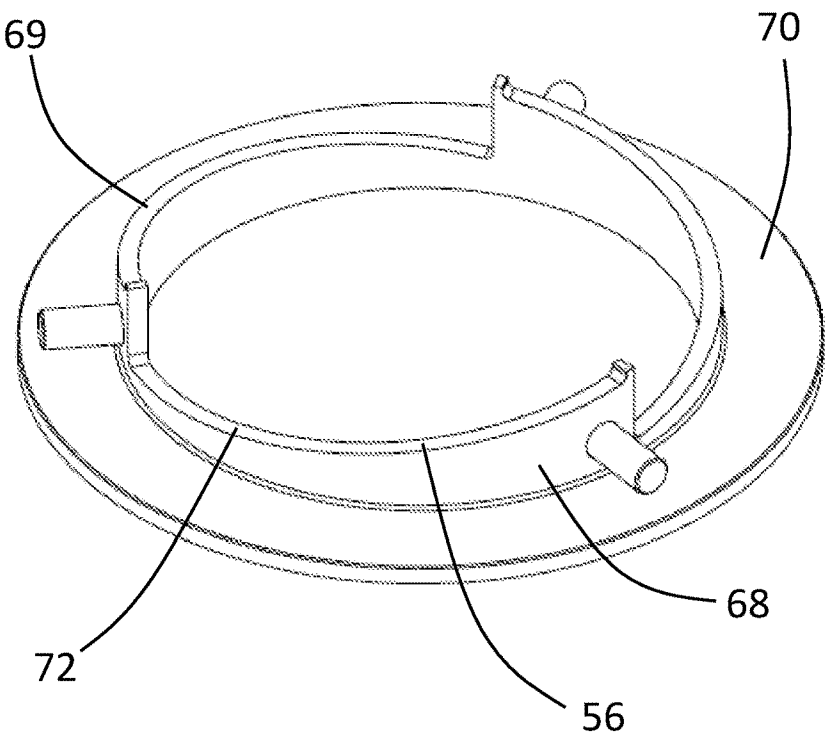
Figure 3A:
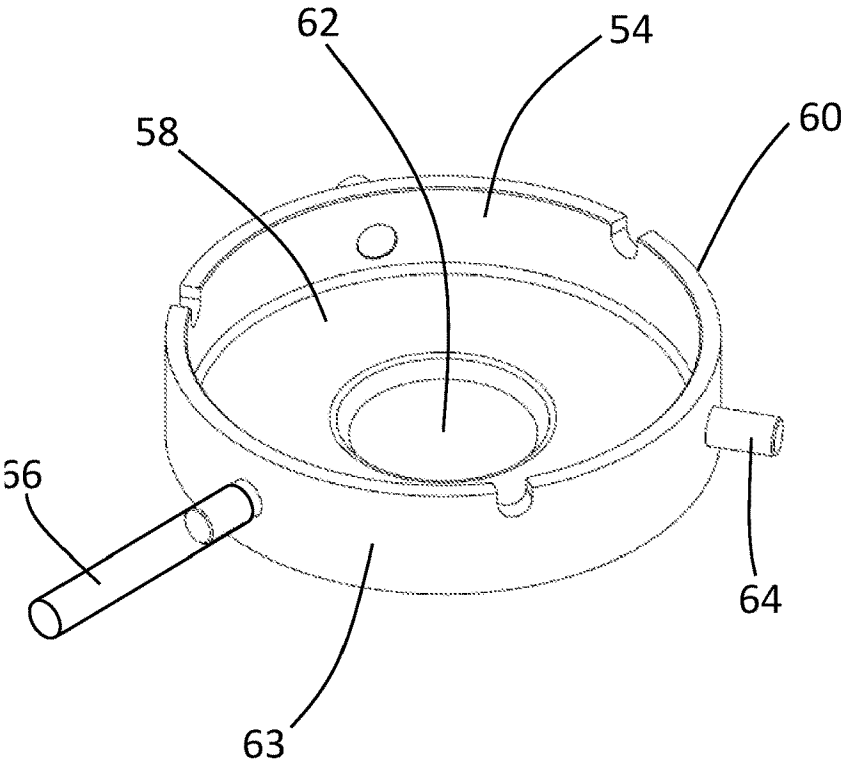
Figure 4:
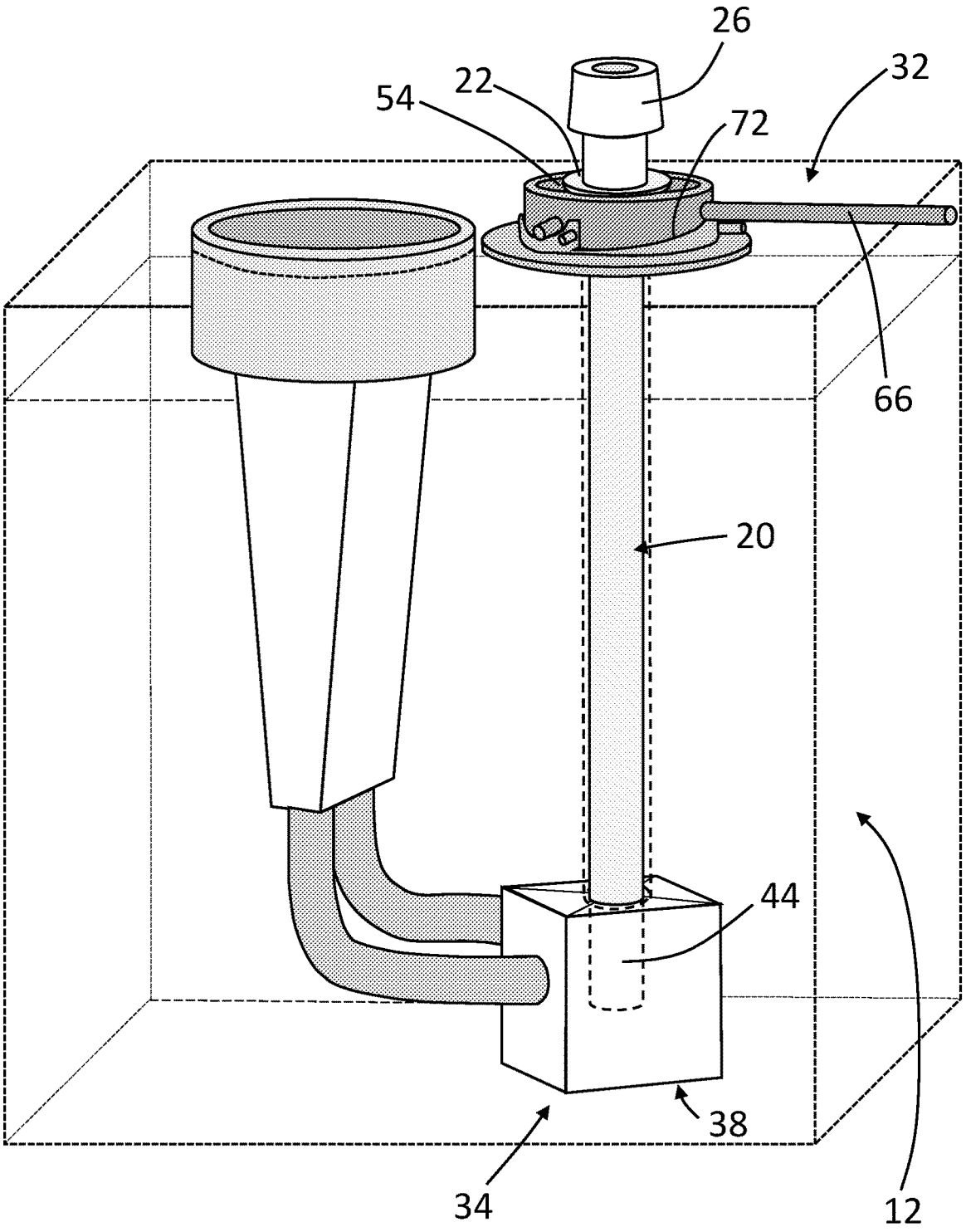
Figure 5B:
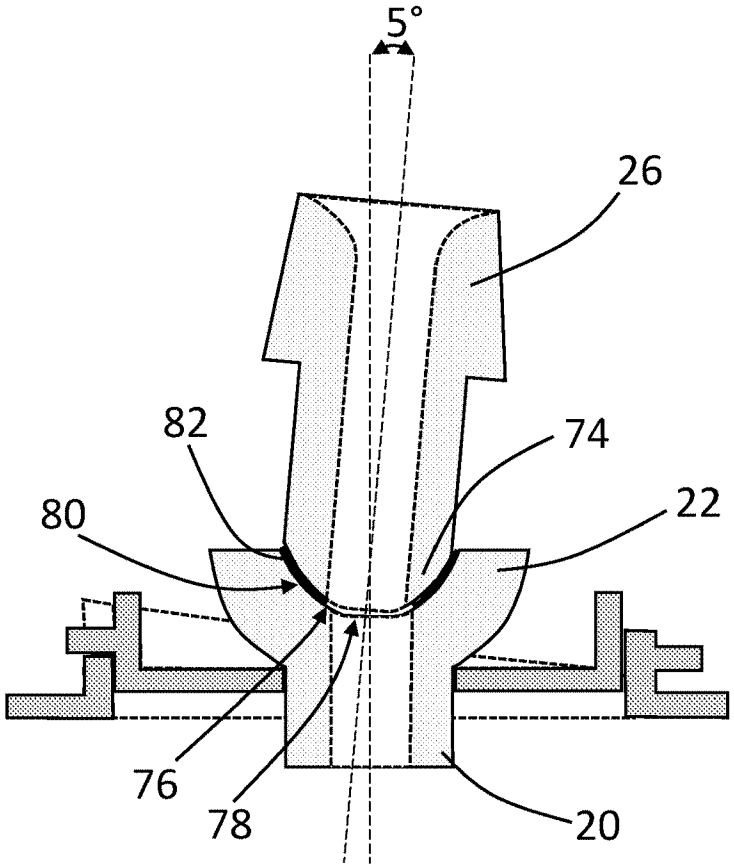
Figure 5A:
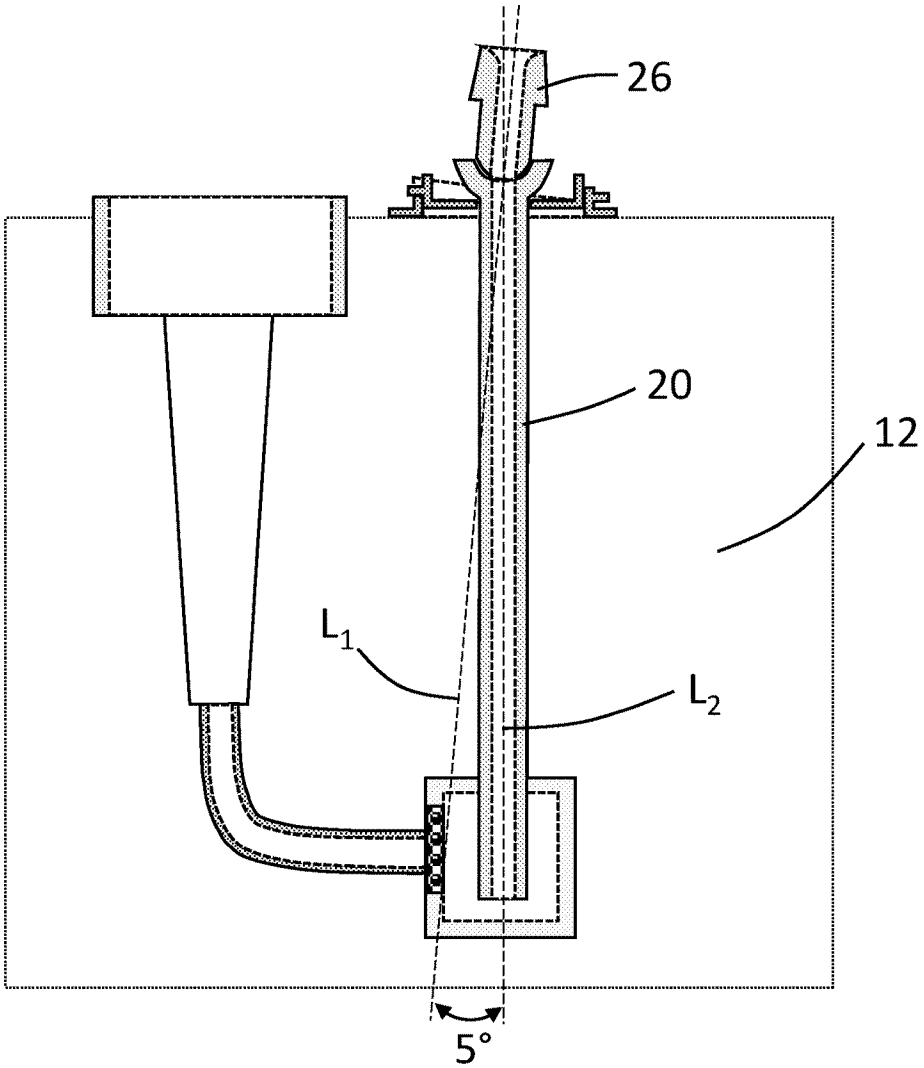
Figure 7A:
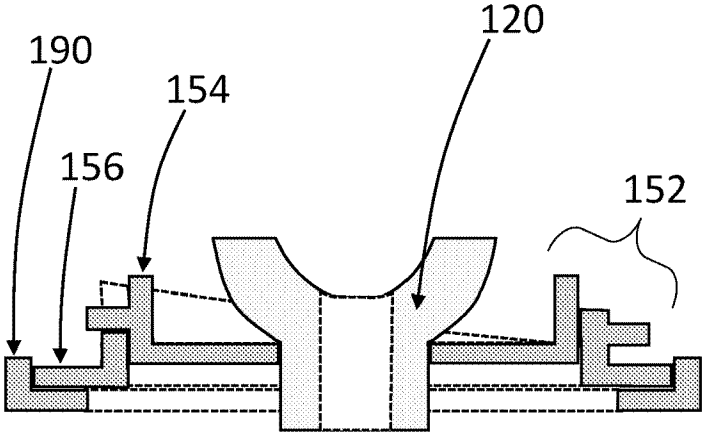
Figure 6:
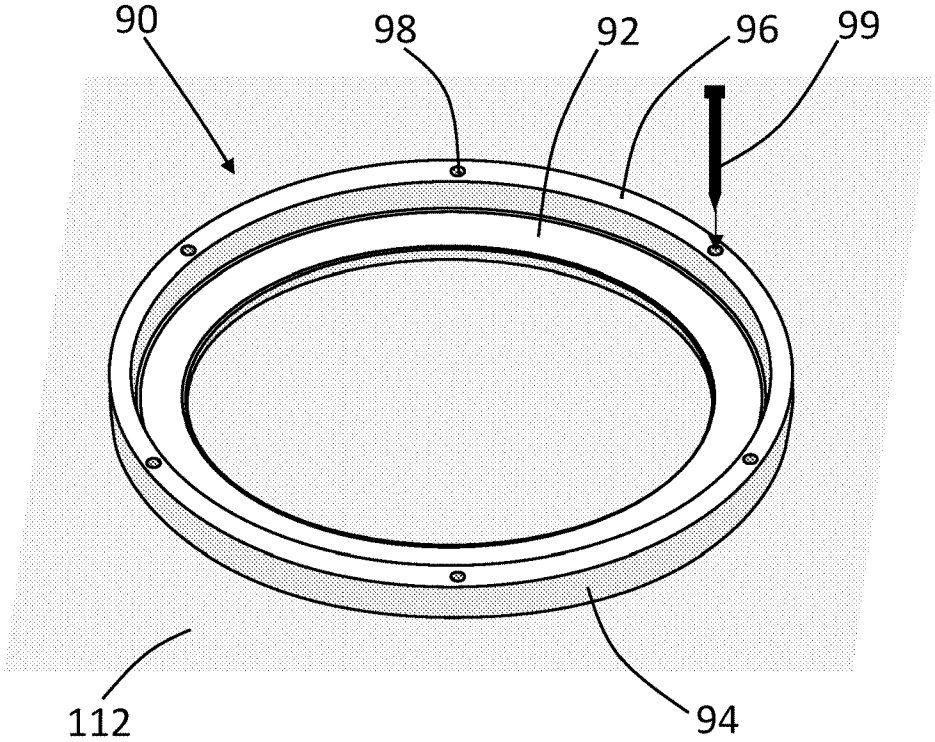
Figure 7B:
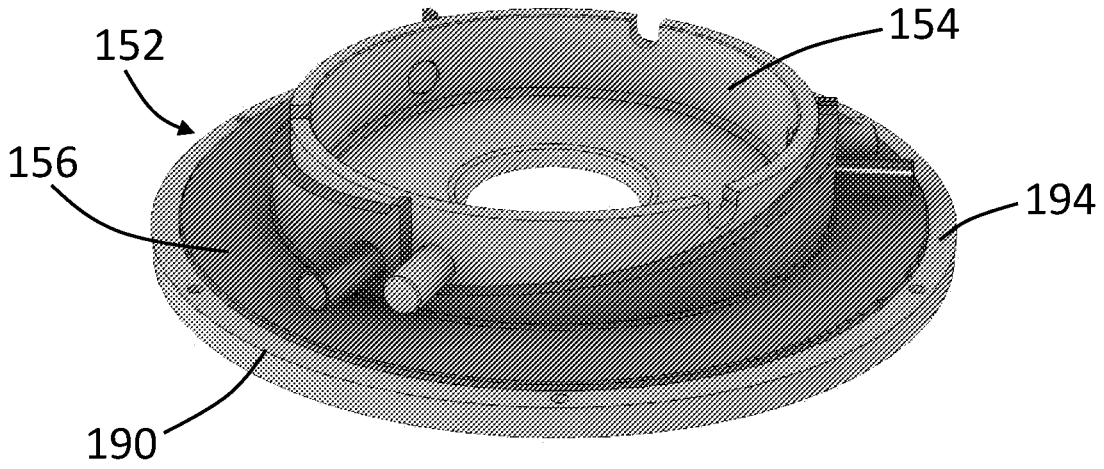
Figure 7C:
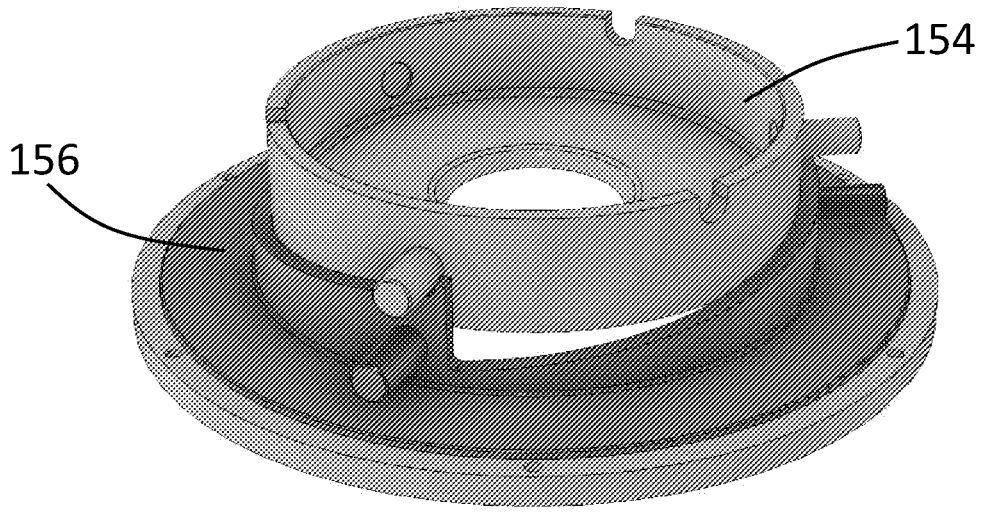
Figure 8B:
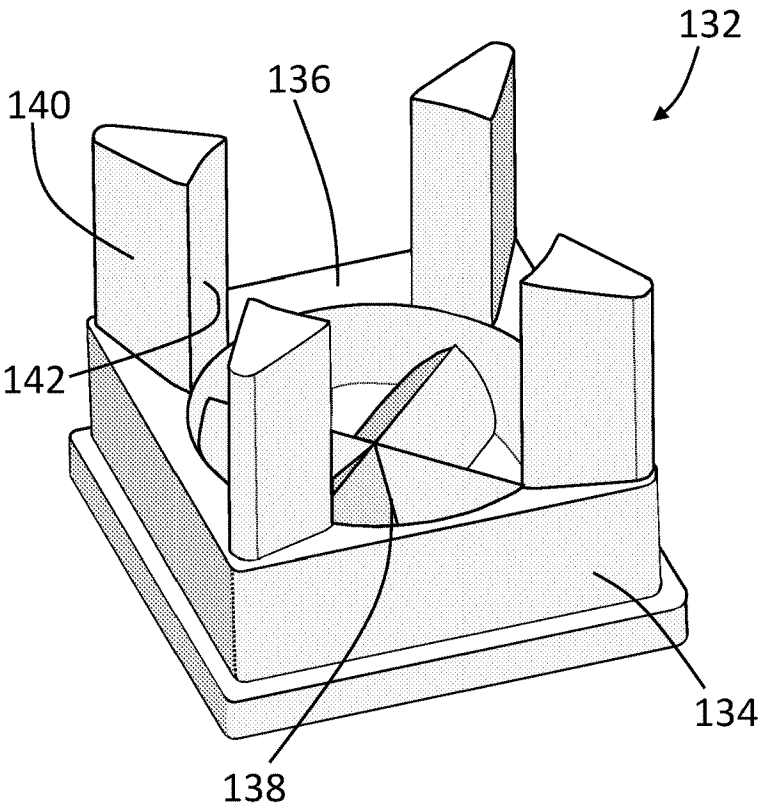
Figure 8A:
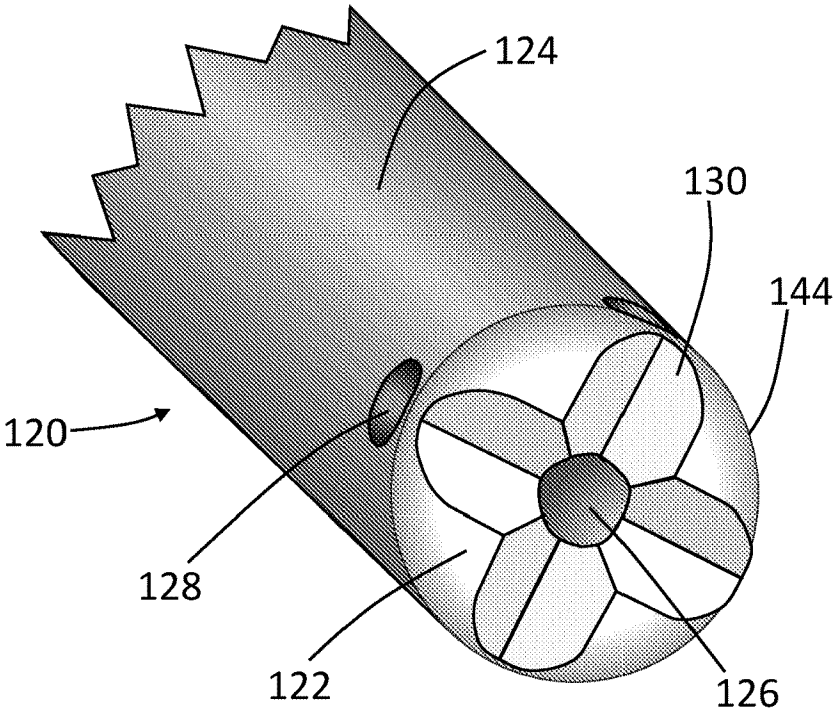
Figure 8D:
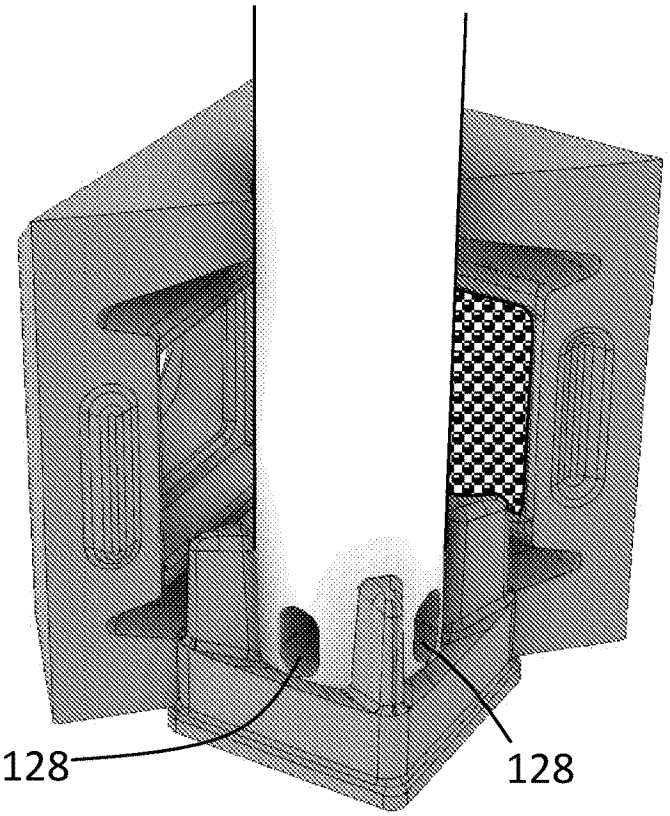
Figure 8C:
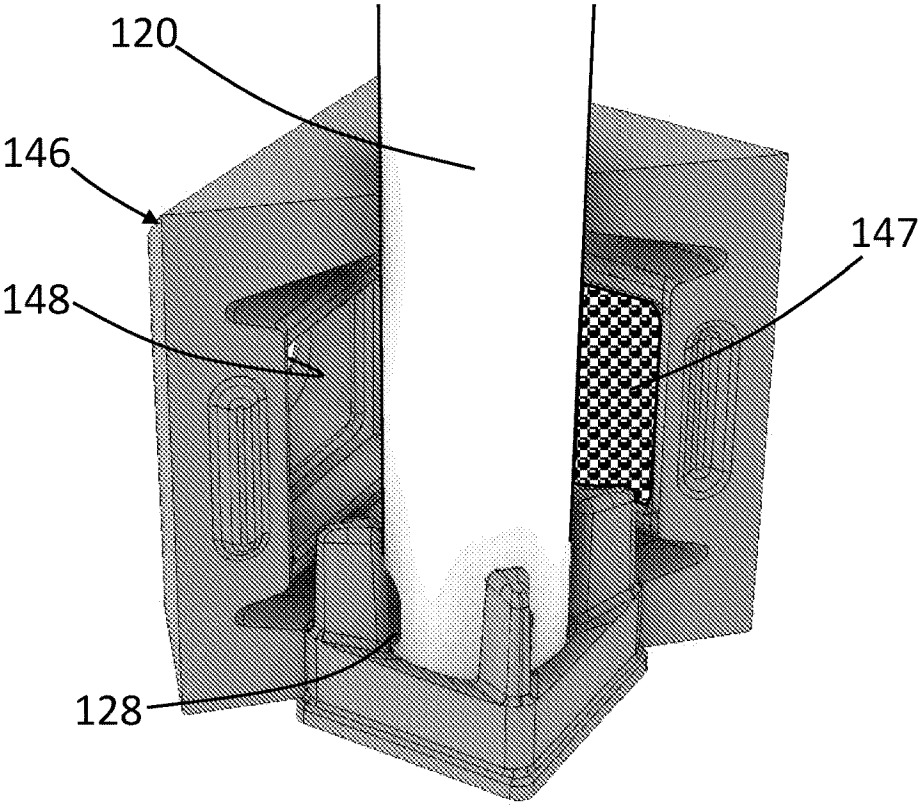

FIG. 3*a* and FIG. 3*b* are perspective views of the two components comprising the lifting mechanism of FIG. 1;

FIG. 4 is a perspective view of the casting system of FIG. 1, wherein the funnel of the shroud is engaged with the ladle nozzle;

FIG. 5*a* and FIG. 5*b* are cross-sectional views showing the connection between the ladle nozzle and the shroud of FIG. 1 in a situation where there is displacement between the mould and the ladle;

FIG. 6 is a perspective view of a third component of a three-part lifting mechanism in an alternative embodiment of the invention;

FIG. 7*a* is a cross-sectional view of a three-part lifting mechanism and a funnel of a shroud supported thereby in an alternative embodiment of the invention;

FIG. 7*b* and FIG. 7*c* are perspective views of the lifting mechanism of FIG. 7*a* in different stages of rotation. FIG. 7*b* shows the mechanism prior to rotation, while FIG. 7*c* shows the mechanism after rotation;

FIG. 8*a* is a perspective view of an end of a shroud in accordance with an embodiment of the invention;

FIG. 8*b* is a perspective view of an impact pad for use with the shroud of FIG. 8*a*; and FIG. 8*c* and FIG. 8*d* are perspective views of the shroud of FIG. 8*a* assembled with a housing and the impact pad of FIG. 8*b*, showing the transition between the partially open (FIG. 8*c*) and fully open (FIG. 8*d*) positions.

With reference to FIG. 1, an embodiment of a casting system 10 according to the invention comprises a mould 12 in which is formed a casting cavity 14. The mould is comprised of an upper part 12*a* and a lower part 12*b* joined horizontally at a parting line 13. The casting cavity 14 is bottom-fed via two inlets 16. Molten metal is supplied to the casting cavity 14 through a shroud 20, which prevents re-oxidation of the metal by protecting it from the atmosphere. The shroud 20 comprises a funnel 22 into which molten metal is poured, and an elongate hollow shaft 24 which feeds the metal into the casting cavity 14. The funnel 22 is located outside of the mould 12, so that it can engage with a nozzle 26 of a ladle (not shown) when in use. The shaft 24 of the shroud 20 is received within a bore 30 formed in an upper surface 32 of the mould 12, and extends substantially perpendicularly thereto. The bore 30 is sized to receive the shroud 20 such there is substantially no gap therebetween while still allowing linear movement of the shroud 20. In fluid communication with the casting cavity 14 is an open feeder sleeve 15, which extends between the casting cavity 14 and the upper surface 32 of the mould 12.

The bore 30 extends between the upper surface 32 and a housing 34, located within the mould 12. The housing 34 is cuboid in shape, comprising four prism shaped sections fixed together and having an upper wall 36, a lower wall 38 and four side walls 40. The housing 34 may be made from a suitable refractory material, such as fused silica. The shaft 24 of the shroud 20 passes through an opening 42 in the upper wall 36, such that an end 44 of the shroud 20, opposite the funnel 22, is received within the housing 34. Two of the four side walls 40 have an outlet 46 therein. A filter (not shown) may be located adjacent each of the outlets 46, such that molten metal passes through the filters when it exits the housing 34.

A running system 48 comprising a pair of conduits 50 extends sidewardly from the filter housing 34, with one conduit 50 leading from each of the outlets 46. The conduits 50 bend upwardly to join the inlets 16 of the casting cavity 14, each conduit 50 feeding into a separate one of the inlets 16. Thus, a flow path for molten metal is provided downwardly through the funnel 22 and shaft 24 of the shroud 20, into the filter housing 34, through the filters and out of the filter housing 34 through the outlets 46, through the conduits 50 and upwardly into the casting cavity 14.

As stated above, the shroud 20 is linearly moveable within the bore 30 so that it can be lifted upwardly for engagement with the ladle nozzle 26. The shroud 20 is lifted by a lifting mechanism 52 which is located on the upper surface 32 of the mould 12.

Figure 2:
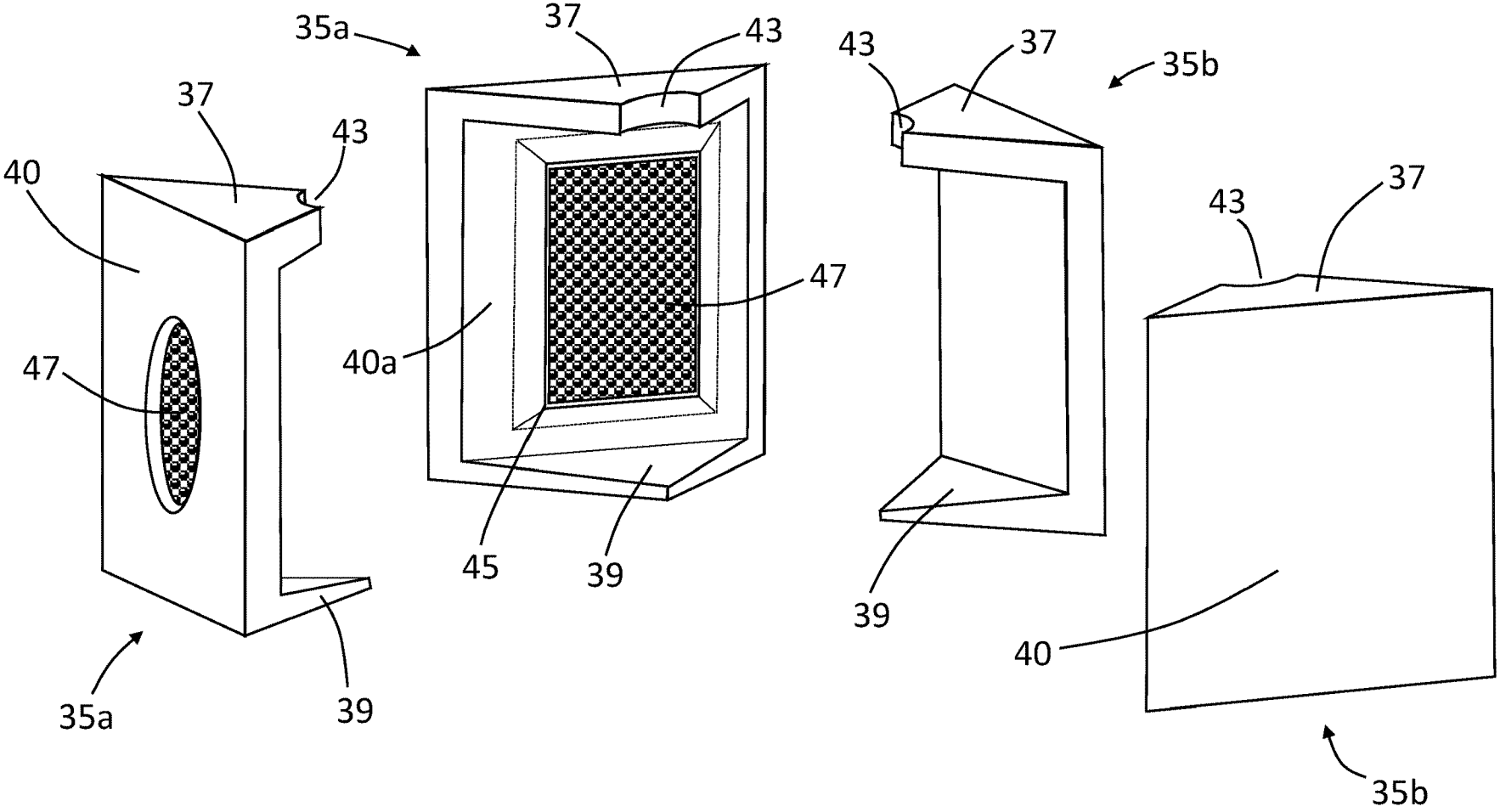
FIG. 2 is an exploded perspective view of the housing of FIG. 1 showing the individual components.

FIG. 2 shows the four individual segments 35*a*, 35*b* that fit together to form the housing 34. Two of the segments 35*a* have an outlet 46 in the sidewall 40, while the other two 35*b* have no outlet. Each of the segments 35*a*, 35*b* has a triangular base 39, a sidewall 40 and a triangular shaped roof 37, the roof having a quarter circle (i.e. 90°) cut out 43. When the pieces are fitted together, the four roof segments create the upper wall 36 of the housing and the cut outs 43 create the circular opening 42 through which the shaft 24 of the shroud 20 passes. Similarly, the four triangular bases 39 fit together to create the lower wall 38 of the housing. Two of the housing segments 35*a* have integrated into an internal surface 40*a* of the sidewall 40 a raised profiled frame 45 that holds in place a ceramic foam filter 47, such that the centre of the filter 47 is positioned over the outlet 46 in the sidewall 40. In use, the segments 35*a*, 3*b* are fixed together by fastening and tightening a metal band (not shown) around the four sidewalls 40 of the housing 34.

With further reference to FIGS. 3*a* and 3*b*, the lifting mechanism 52 comprises an inner collar 54 which sits concentrically within an outer collar 56. The inner collar 54 comprises an annular seat 58 surrounded by a circular rim 60. In use, the funnel 22 of the shroud 20 is supported on the annular seat 58, with the shaft 24 of the shroud 20 passing through a central hole 62 in the seat 58. On an exterior surface 63 of the circular rim 60 two pegs 64 are provided and, spaced apart from the pegs 64, a handle 66.

The outer collar 56 comprises a cylindrical wall 68 surrounded by an annular base 70. The base 70 is mounted on the upper surface of the mould 12, in use. During preparation of the mould 12 the outer collar 56 is placed in position and is held in place when the moulding sand cures and hardens. Portions of an upper end 69 of the cylindrical wall 68 are cut away so as to provide three ramped or spiral surfaces 72. In the embodiment shown, each spiral surface 72 extends around approximately 120° of the circumference of the cylindrical wall 68.

When the lifting mechanism 52 is assembled, the pegs 64 and handle 66 of the inner collar 54 rests on the spiral surfaces 72 of the outer collar 56. It can be seen that as the inner collar 54 is rotated using the handle 66, the pegs 64 and handle 66 travel along the spiral surfaces 72, causing the inner collar 54, and thus the shroud 20 supported by the inner collar 54, to be lifted upwardly. The inner and outer collars 54, 56 thus function as a cylindrical cam, with the pegs 64 and handle 66 constituting followers.

In FIG. 1, the inner collar 54 of the lifting mechanism 52 is in a first position, with the pegs and handle at a lowest point on the spiral surfaces 72. In this position, the shroud 20 is lowered such that the shaft 24 extends almost to the bottom of the housing 34, and the funnel 22 is not engaged with the ladle nozzle 26. It can be seen that rotation of the inner collar 54 anticlockwise through an angle of approximately 90° causes the pegs and handle to travel upwardly along the spiral surfaces 72 of the outer collar 56, thereby moving the lifting mechanism 52 to a second position as shown in FIG. 4. In the second position, the inner collar 54 and the funnel 22 seated therein are lifted upwardly, away from the upper surface 32 of the mould 12, and the funnel 22 is brought into engagement with the ladle nozzle 26. The end 44 of the shroud 20, opposite the funnel 22, is lifted away from the lower wall 38 of the housing 34 but remains within the housing 34. It will be therefore be appreciated that the angle through which the inner collar 54 must be rotated will depend on the extent of vertical movement of the inner collar 54 and shroud 20 that is required to bring the funnel 22 into engagement with the nozzle 26, which may vary according to the height of the mould 12 and the positioning of the ladle. The lifting mechanism 52 may be retained in the second position manually during pouring by an operator holding the handle 66 to prevent it from travelling downwardly along the spiral surface 72. However, it will be appreciated that in some embodiments a lock may be provided to hold the lifting mechanism 52 in the second position.

With reference to FIGS. 5*a* and 5*b*, perfect alignment between the ladle and the mould 12 may not always be achieved such that there is vertical displacement. In the embodiment shown in FIG. 5*a*, the longitudinal axis $L_1$ of the ladle nozzle 26 is offset from the longitudinal axis ($L_2$) of the shroud 20 by 5°. As shown more clearly in FIG. 5*b*, a tip 74 of the ladle nozzle 26 is part-spherical, or flat top domed, in shape. The funnel 22 of the shroud 20 has an interior surface 76 that is also part-spherical in shape, with a flat bottom 78 and a curved side 80. The interior surface 76 of the funnel 22 is lined with a gasket 82. The part-spherical shape of the nozzle 26, funnel 22 and gasket 82 ensures that the connection is hermetically sealed even if displacement between the ladle and the mould 12 occurs.

In the embodiments of the invention described above, rotation of the inner collar 54 of the lifting mechanism 52 relative to the outer collar 56 (which remains fixed relative to the mould 12) effects lifting of the shroud 20 for engagement with the ladle nozzle 26, with simultaneous rotation of the shroud 20. However, in alternative embodiments, the shroud may be lifted by rotation of the outer collar such that the inner collar and shroud are not rotated during lifting. To facilitate this, a third component may be provided to give a three-part lifting mechanism. FIG. 6 shows a third component or mounting ring 90 which comprises an annular base 92 surrounded by a circular rim 94. In the embodiment shown, an upper surface 96 of the circular rim 94 has a series of holes 98 therein that extend downwardly though the full height of the rim 94. The holes 98 receive nails or metal pins 99 to fix the mounting ring 90 to a surface 112 of the mould.

In use, the inner and outer collars of the lifting mechanism fit concentrically into and on top of the mounting ring 90.

With reference to FIG. 7*a*, a three-component lifting mechanism 152 comprises an inner collar 154 which sits concentrically within an outer collar 156. In turn, the outer collar sits concentrically within the circular rim 194 of a mounting ring 190 that is fixed to the upper surface of a mould (not shown). Thus, unlike the embodiment of FIG. 3, the outer collar 156 is not fixed to the upper surface of the mould but is rotatable relative to it and also relative to the mounting ring 190.

FIG. 7*b* shows the lifting mechanism 152 prior to rotation. Clockwise rotation of the outer collar 156 results in vertical movement of the inner collar 154 without rotation of the inner collar 154, to the position shown in FIG. 7*c*. Thus, a shroud supported by the inner collar 154 is simply lifted, without rotation of the shroud. Subsequent rotation of both of the inner 154 and outer 156 collars together would then effect rotation of the shroud. It will also be appreciated that the three-part lifting mechanism may be operated in the same way as the two-part lifting mechanism of FIG. 3, i.e. anti-clockwise rotation of the inner collar 154 with simultaneous lifting of the inner collar 154 and shroud supported therein.

FIG. 8*a* shows a lower end 144 (i.e. opposite the nozzle) of a shroud 120 that may be used in conjunction with the lifting mechanism 152 of FIG. 7. The bore of the shroud 120 is closed by a base 122 having a central opening 126 therein. Four horizontal outlets 128 are provided in the shaft 124 of the shroud 120, adjacent to the base 122. The base 122 is shaped, having four petal-shaped indentations 130 which radiate from the central opening 126 to the periphery where the base 122 meets the shaft 124.

FIG. 8*b* shows an impact pad 132 for use with the shroud 120 of FIG. 8*a*. The impact pad 132 comprises a substantially square block 134 having an upper surface 136. The upper surface 136 has a central region 138 which is complementary in shape to the shape of the base 122 of the shroud 120. Four pillars 140 extend vertically upwardly from the upper surface 136, one pillar 140 in each corner of the impact pad 132. The pillars 140 are substantially triangular in cross-section, the apex of each triangle being approximately aligned with the corners of the square block 134. An inward-facing surface 142 of each pillar is slightly curved, the degree of curvature being selected to match that of the shaft 124 of the shroud 120. The height and spacing of the pillars 140 and the width of their inwardly-facing surfaces 142 are selected so that the pillars 140 can completely cover the horizontal outlets 128 of the shroud 120 in the assembled system. The shaping of the base 122 of the shroud 120 and the central region 138 of the upper surface 136 of the impact pad 132 facilitates correct alignment between the horizontal outlets 128 and the pillars 140. It will be appreciated that the fit between the shroud 120 and the impact pad 132 must be such that the pillars 140 are able to prevent the flow of metal through the horizontal outlets 128 when the pillars 140 and the outlets 128 are aligned (both when the shroud is lowered and raised), but that the shroud 120 can still be rotated relative to the impact pad 132.

FIG. 8*c* and FIG. 8*d* show the lower end of the shroud 120 assembled with the impact pad 132 and two segments of the filter housing 146 (for simplicity the other two segments are not shown). One segment is shown with a filter 147 in position; the other is shown without a filter so that the housing outlet 148 can be seen, although it will be appreciated that a filter may be present in use. Depicted is the transition from an intermediate partially open position (FIG. 8*c*) to a fully open position (FIG. 8*d*) upon operation of the lifting mechanism (not shown).

With reference to FIGS. 7 and 8, in use, prior to lifting of the shroud 120 by the lifting mechanism 152, the base 122 of the shroud 120 mates with the complementary central region 138 of the upper surface 136 of the impact pad 132, such that the central opening 126 in the base 122 is closed. The horizontal outlets 128 in the shaft 124 are also aligned with, and closed by, the pillars 140, thereby ensuring that metal flow from the shroud 120 is prevented.

Upon rotation of the outer collar 156 of the lifting mechanism 152, the inner collar 154 and the shroud 120 supported therein are lifted upwardly. Accordingly, the base 122 of the shroud 120 is no longer in contact with the upper surface 136 of the impact pad 132, thereby enabling metal flow through the central opening 126. However, since no rotation of the shroud 120 has occurred, the horizontal outlets 128 remain closed by the pillars 140. On casting, the stopper in the bottom pour ladle is opened and metal flows through the nozzle, into the shroud 120. The metal exits the shroud 120 via the central outlet 126 in the base 122, flows through the gap between the shroud 120 and the impact pad 132, primes the filters (not shown) present in the filter housing and then begins to flow into a running system (not shown).

The inner 154 and outer 156 collars are then rotated together relative to the mounting ring 190 and the mould. This rotates the shroud 120 without changing its vertical position relative to the mould (or the ladle nozzle). Prior to rotation the shroud 120 is in a closed position in which the horizontal outlets 128 are blocked by the pillars 140 of the impact pad. Upon rotation of the shroud 120, the horizontal outlets 128 are moved out of alignment with the pillars 140 and opened partially (FIG. 8*c*) and then fully (FIG. 8*d*), thereby steadily increasing the flow of metal into the filter housing 146, the running system and the casting cavity within the mould.

The use of a lifting mechanism in which rotation of the shroud can be effected independently of lifting, together with the provision of horizontal outlets in the shroud which can be opened and closed by rotation of the shroud relative to the impact pad, gives the advantage of greater control of metal flow. Initially, when the mould cavity is empty and there is no back pressure, a low flow rate can be used by opening only the central outlet in the base of the shroud. The flow rate can then be increased as the metal level in the mould cavity rises by opening the horizontal outlets. This retains and controls the metal pressure within the whole system throughout pouring. In addition, controlling the flow when the metal first enters the filter housing reduces the impact and metal pressure on the filters and hence reduces the potential for filter breakages and turbulence behind the filters. The present invention enables these advantages to be achieved while keeping the shroud pressurised, which is typically done by keeping the ladle nozzle fully open.

EXAMPLES

Testing was conducted in a European steel foundry making large steel castings for construction industry vehicles.

Comparative Example 1

Conventionally poured steel castings having a cast weight of 750 kg were bottom fed via three equally sized tangential ingates equally spaced around the circumference of casting cavity and connected by three runners to the base of the downsprue. Three open exothermic risers (feeders) were positioned above and in direct fluid communication with the top of the casting cavity. The horizontally parted moulds were made from acid set furan resin bonded reclaimed chromite sand, and purged with argon prior to casting. The castings were poured from a conventional bottom pour ladle placed above the mould so that the nozzle was less than 300 mm above the surface of the mould, positioned above the pouring cup and downsprue of the mould. Liquid metal was poured from the bottom pour ladle at a pouring temperature of 1555° C.

Example 1

The running system of Comparative Example 1 was modified to accommodate a fused silica shroud having dimensions 1250 mm length, 80 mm external diameter and 40 mm internal (bore) diameter. The funnel of the shroud was placed inside a lifting mechanism in accordance with FIG. 3, fitted to the top of the mould. At the base of the downsprue a triangular prism shaped fused silica housing was located, having three side walls. Each of these walls had an outlet with a zirconia based 10 ppi foam filter, 100 mm×100 mm×25 mm, manufactured and sold by Foseco under the STELEX Zr brand, located adjacent to the outlet. The outlets were connected to the bottom of the casting cavity in a similar manner to the ingates of Comparative Example 1. The mould was purged with argon and the shroud raised up using the lifting mechanism so that the funnel of the shroud engaged with an iso-pressed clay graphite nozzle, sold by Foseco under the VAPEX trade name, attached to the base of bottom pour ladle. The funnel of the shroud and the end of the nozzle were sealed by a graphitised gasket. Liquid metal was poured from the bottom pour ladle at a pouring temperature of 1555° C. The pouring time was 28 seconds from the stopper in the ladle opening till closing.

Castings produced by the system of Example 1 were seen to be considerably cleaner than those produced by the system of Comparative Example 1, such that it was possible to conduct the first magnetic inspection after just shot blasting and before any heat treatment and grinding. Magnetic particle inspection (MPI) of the Example 1 casting surface showed it to be significantly cleaner than the Comparative Example even after any heat treatment and grinding. Furthermore, steel castings have to undertake a series of welding cycles to remove any inclusions and surface defects detected by magnetic inspection before being shipped to the end user customer. For the Comparative casting produced by conventional pouring, typically the casting had to undergo at least 5 welding cycles. In contrast, the casting produced by the casting system of the invention (Example 1) only required a single welding cycle of a few spot defects before quenching and DC magnetic control before being ready for shipment, this equating to a reduction in welding time of over 30 hours (per casting) giving the foundry considerable cost savings and significantly reduced delivery time to the end user customer.

The invention claimed is:

1. A system for casting molten metals comprising:

a mould comprising a casting cavity having an inlet, and a bore between an upper surface of the mould and the inlet;

a shroud comprising a funnel and a hollow shaft, wherein the funnel is located outside of the mould, adjacent the upper surface, and the hollow shaft is received within the bore and is moveable therein; and a lifting mechanism located on the upper surface of the mould, the lifting mechanism being operable to lift the funnel of the shroud away from the upper surface for bringing the shroud into engagement with a ladle nozzle.

2. The system of claim 1, further comprising a rotating mechanism for rotating the shroud relative to the mould.

3. The system of claim 1, wherein the lifting mechanism is further operable to rotate the shroud relative to the mould.

4. The system of claim 3, wherein the lifting mechanism enables rotation of the shroud to be effected independently of lifting of the shroud.

5. The system of claim 1, wherein the lifting mechanism comprises a first part which is mounted on the surface of the mould, and a second part which supports the funnel of the shroud, wherein the second part is moveable relative to the first part.

6. The system of claim 5, wherein the position of the first part is fixed relative to the mould and wherein the second part is moveable between a first position, in which the shaft is substantially received within the bore of the mould, and a second position, in which a portion of the shaft is lifted out of the bore.

7. The system of claim 5, wherein the position of the first part is moveable relative to the mould, the first part being moveable between a first position, in which the shaft is substantially received within the bore of the mould, and a second position, in which a portion of the shaft is lifted out of the bore.

8. The system of claim 7, wherein the lifting mechanism comprises a third part disposed between the first part and the surface of the mould.

9. The system of claim 1, wherein the lifting mechanism comprises a mechanical, hydraulic or pneumatic actuator or a motor.

10. The system of claim 1, wherein the lifting mechanism comprises a cylindrical cam.

11. The system of claim 10, wherein the lifting mechanism comprises concentric inner and outer collars, and wherein one of the inner and outer collars supports the funnel of the shroud and has a follower which rests on a ramped surface of the other of the inner and outer collars which is mounted on the upper surface of the mould, such that relative rotation of the inner and outer collars causes linear motion of the shroud, and optionally wherein multiple ramped surfaces are provided, each ramped surface extending over a portion of the inner or outer collar in a circumferential direction.

12. The system of claim 11, wherein the shroud is seated on the inner collar, the inner collar having a follower which rests on a ramped surface of the outer collar.

13. The system of claim 11, wherein the lifting mechanism further comprises a handle for effecting relative rotation of the inner and outer collars, optionally wherein the handle is attached to or constitutes the follower.

14. The system of claim 1, further comprising one or more filters located between the bore and the inlet of the casting cavity.

15. The system of claim 14, wherein the one or more filters are located within a housing which is connected to the bore and which receives an end of the shroud, optionally wherein the system further comprises a running system between the housing and the inlet of the casting cavity.

16. The system of claim 15, wherein the housing contains an impact pad, and optionally wherein at least one outlet is provided in the shaft adjacent to the end of the shroud, and wherein the impact pad comprises at least one pillar having a surface which abuts the shaft, such that the shroud is rotatable between a position in which the pillar is aligned with the outlet so as to close the outlet and prevent metal flow therethrough, and a position in which the outlet is at least partially open.

17. A method of casting molten metals comprising the steps of:

providing a system according to claim 1;

positioning a bottom pour ladle containing molten metal over the mould such that a nozzle in a base of the ladle is located substantially vertically above the funnel of the shroud;

operating the lifting mechanism so as to lift the funnel of the shroud away from the upper surface of the mould to bring the shroud into engagement with the nozzle;

opening the nozzle, thereby allowing molten metal to flow from the ladle into the shroud;

closing the nozzle to stop the flow of molten metal; and operating the lifting mechanism so as to lower the funnel of the shroud towards the upper surface of the mould to disengage the shroud from the nozzle.

18. The method of claim 17, wherein operating the lifting mechanism so as to lift the funnel of the shroud also effects rotation of the shroud relative to the mould.

19. The method of claim 17, wherein operating the lifting mechanism lifts the funnel of the shroud without rotating the shroud relative to the mould, and wherein the method further comprises the step of, after opening the nozzle, rotating the shroud.

* * * * *